US009235163B2

(12) United States Patent
Wada et al.

(10) Patent No.: US 9,235,163 B2
(45) Date of Patent: Jan. 12, 2016

(54) DEVELOPMENT DEVICE AND IMAGE FORMING APPARATUS

(71) Applicant: KYOCERA Document Solutions Inc., Osaka (JP)

(72) Inventors: Minoru Wada, Osaka (JP); Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/501,886

(22) Filed: Sep. 30, 2014

(65) Prior Publication Data

US 2015/0104216 A1 Apr. 16, 2015

(30) Foreign Application Priority Data

Oct. 10, 2013 (JP) ..... 2013-212580

(51) Int. Cl.
*G03G 15/08* (2006.01)
*G03G 15/09* (2006.01)

(52) U.S. Cl.
CPC ..... *G03G 15/0921* (2013.01); *G03G 15/0893* (2013.01); *G03G 15/0928* (2013.01)

(58) Field of Classification Search
CPC ..... G03G 15/0893; G03G 15/0889; G03G 15/0877; G03G 15/0891; G03G 15/0865
USPC ..... 399/254
See application file for complete search history.

(56) References Cited

U.S. PATENT DOCUMENTS 5,208,503 A * 5/1993 Hisey ..... 310/216.054
2012/0213554 A1* 8/2012 Hayashi et al. ..... 399/254

FOREIGN PATENT DOCUMENTS

JP H10-142942 A 5/1998

OTHER PUBLICATIONS

JP 59139068 A , publication date: Aug. 9, 1984.*
JP 63313180 A, publication date: Dec. 21, 1988.*

* cited by examiner

*Primary Examiner* — Walter L Lindsay, Jr.
*Assistant Examiner* — Frederick Wenderoth
(74) *Attorney, Agent, or Firm* — Studebaker & Brackett PC

(57) ABSTRACT

A development device includes a development case, a first agitating/conveying member and a second agitating/conveying member. The first agitating/conveying member is arranged below the second agitating/conveying member to convey the developer in a first direction. The second agitating/conveying member conveys the developer in a second direction as an opposite direction to the first direction to supply the developer to the developer carrier. The development case includes a first conveyance chamber, a second conveyance chamber, a first communicating portion communicating end parts of the first conveyance chamber and second conveyance chamber in the first direction, and a second communicating portion communicating end parts of the first conveyance chamber and second conveyance chamber in the second direction. The developer carrier has a first ferromagnetic area having magnetic force stronger than another area of the developer carrier, in which the first ferromagnetic area corresponds to the first communicating portion.

6 Claims, 4 Drawing Sheets

DEVELOPMENT DEVICE AND IMAGE FORMING APPARATUS

INCORPORATION BY REFERENCE

This application is based on and claims the benefit of priority from Japanese Patent application No. 2013-212580 filed on Oct. 10, 2013, the entire contents of which are incorporated herein by reference.

BACKGROUND

The present disclosure relates to a development device including an agitating/conveying member agitating/conveying two-component developer and an image forming apparatus including the development device.

In a development device visualizing an electrostatic latent image formed on a photosensitive drum to a toner image by using two-component developer consisting of a toner and a carrier, an agitating/conveying member agitating, frictionally charging and conveying the toner and carrier is provided.

Recently, a demand for space saving of an image forming apparatus is risen, and moreover, in a color multifunction peripheral and a color printer in a tandem type arranging a plurality of development devices in parallel, it is necessary to miniaturize the development device and to narrow a distance between the photosensitive drums. Thereupon, there is a development device having two agitating/conveying members disposed vertically to narrow the distance between the photosensitive drums.

In a case where the agitating/conveying members are disposed vertically, the developer is circulated between an upper conveyance chamber having an upper agitating/conveying member and a lower conveyance chamber having a lower agitating/conveying member. When the developer is drawn up from the lower conveyance chamber to the upper conveyance chamber, it is necessary to move the developer against gravity. As a feeding member drawing up the developer, a magnet roller connected coaxially to a developer carrier may be applied.

However, in a case where the magnet roller is connected coaxially to the developer carrier, a length in an axial direction of the developer carrier is lengthened and the development device is enlarged. Further, due to a complicated structure connecting the developer carrier and feeding member, cost increase is brought.

In a case where the agitating/conveying members are respectively arranged in the upper and lower conveyance chambers, a developer amount fed to the developer carrier is decreased in a communicating portion between the upper conveyance chamber and lower conveyance chamber. As a result, there are problems that a toner amount becomes insufficient and image density is lowered.

Because of this, the development device may be configured so that the agitating/conveying member and developer carrier is lengthened more than the photosensitive drum and image forming is carried out at a center part of the developer carrier except for the communicating portion. However, a length of the development device in an axial direction of the photosensitive drum is lengthened and the development device is enlarged.

SUMMARY

In accordance with an embodiment of the present disclosure, a development device includes a development case containing two-component developer consisting of a carrier and a toner, a first agitating/conveying member and a second agitating/conveying member agitating and conveying the developer in the development case and a developer carrier carrying the developer supplied from the second agitating/conveying member by magnetic force. The first agitating/conveying member is arranged below the second agitating/conveying member to convey the developer in a first direction as one direction of the axial directions of the developer carrier. The second agitating/conveying member conveys the developer in a second direction as an opposite direction to the first direction to supply the developer to the developer carrier. The development case has a first conveyance chamber in which the first agitating/conveying member is arranged, a second conveyance chamber in which the second agitating/conveying member is arranged, a partition part partitioning into the first conveyance chamber and second conveyance chamber, a first communicating portion communicating end parts of the first conveyance chamber and second conveyance chamber in the first direction, and a second communicating portion communicating end parts of the first conveyance chamber and second conveyance chamber in the second direction. The developer carrier has a first ferromagnetic area having magnetic force stronger than another area of the developer carrier, in which the first ferromagnetic area corresponds to the first communicating portion.

In accordance with an embodiment of the present disclosure, an image forming apparatus includes a development device. The development device has a development case containing two-component developer consisting of a carrier and a toner, a first agitating/conveying member and a second agitating/conveying member agitating and conveying the developer in the development case and a developer carrier carrying the developer supplied from the second agitating/conveying member by magnetic force. The first agitating/conveying member is arranged below the second agitating/conveying member to convey the developer in a first direction as one direction of the axial directions of the developer carrier. The second agitating/conveying member conveys the developer in a second direction as an opposite direction to the first direction to supply the developer to the developer carrier. The development case has a first conveyance chamber in which the first agitating/conveying member is arranged, a second conveyance chamber in which the second agitating/conveying member is arranged, a partition part partitioning into the first conveyance chamber and second conveyance chamber, a first communicating portion communicating end parts of the first conveyance chamber and second conveyance chamber in the first direction, and a second communicating portion communicating end parts of the first conveyance chamber and second conveyance chamber in the second direction. The developer carrier has a first ferromagnetic area having magnetic force stronger than another area of the developer carrier, in which the first ferromagnetic area corresponds to the first communicating portion.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, a development device and an image forming apparatus according to an embodiment of the present disclosure will be described.

Figure 1:
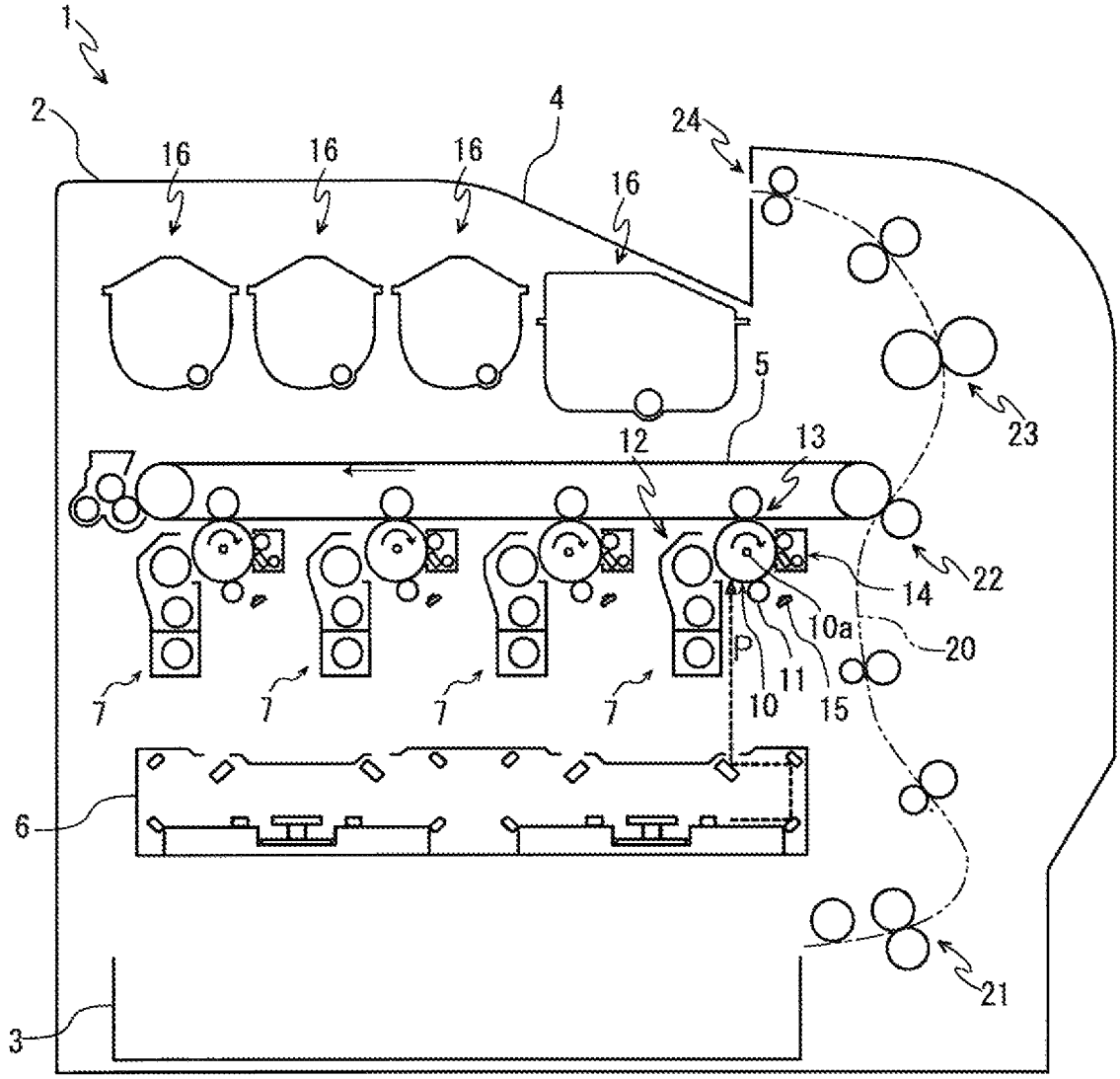
FIG. 1 is a schematic diagram schematically showing a structure of a color printer in accordance with an embodiment of the present disclosure.

First, with reference to FIG. 1, an entire structure of a color printer 1 as the image forming apparatus will be described. FIG. 1 is a schematic diagram schematically showing the structure of the color printer in accordance with the embodiment of the present disclosure. In the following description, the left-hand side of FIG. 1 indicates the front side of the printer 1 and orthogonal directions to forward and backward directions as viewed from the front side indicate left and right directions.

The color printer 1 includes a box-formed printer main body 2. In a lower part of the printer main body 2, a sheet feeding cartridge 3 storing sheets (not shown) is installed and, in an upper end of the printer main body 2, an ejected sheet tray 4 is provided.

In an upper part of the printer main body 2, an intermediate transferring belt 5 is disposed around a plurality of rollers. Below the intermediate transferring belt 5, an exposure device 6 composed of a laser scanning unit (LSU) is arranged. At a lower side of the intermediate transferring belt 5, a plurality of image forming parts 7 are installed for respective colors of yellow (Y), magenta (M), cyan (C) and black (B). In each image forming part 7, a photosensitive drum 10 is rotatably attached by a support axis 10*a*. As the photosensitive drum 10, a photoconductor made of amorphous silicon (a-Si) or an organic photoconductor (OPC) may be applied. Around the photosensitive drum 10, a charger 11, a development device 12, a first transferring part 13, a cleaning device 14 and a static eliminator 15 are located along the rotation direction (refer to an arrow in FIG. 1) of the photosensitive drum 10. Above each development device 12, a developer container 16 is arranged.

At the rear side in the printer main body 2, a conveying path 20 for the sheet is positioned. At an upstream end of the conveying path 20, a sheet feeding part 21 is positioned. At an intermediate stream part of the conveying path 20, a second transferring part 22 is positioned at the rear end of the intermediate transferring belt 5. At a downstream part of the conveying path 20, a fixing part 23 is positioned. At a downstream end of the conveying path 20, an ejection port 24 is positioned.

Next, the operation of forming an image by the color printer 1 having such a configuration will be described.

When the power is supplied to the color printer 1, various parameters are initialized and initial determination, such as temperature determination of the fixing part 23, is carried out. Subsequently, in the color printer 1, when image data is inputted and a printing start is directed from a computer or the like connected with the color printer 1, image forming operation is carried out as follows.

First, the surface of the photosensitive drum 10 is electric-charged by the charger 11. Then, exposure corresponding to the image data to the photosensitive drum 10 is carried out by a laser light (refer to an arrow P) from the exposure device 6, thereby forming an electrostatic latent image on the surface of the photosensitive drum 10. The electrostatic latent image is developed to a toner image having a correspondent color in the development device 12. The toner image is first-transferred onto the surface of the intermediate transferring belt 5 in the first transferring part 13. The above-mentioned operation is repeated in order by the respective image forming parts 7, thereby forming the toner image having full color onto the intermediate transferring belt 5. Incidentally, toner remained on the photosensitive drum 10 is removed by the cleaning device 14 and residual electric charge is eliminated by the static eliminator 15.

On the other hand, the sheet fed from the sheet feeding cartridge 3 or a manual bypass tray (not shown) by the sheet feeding part 21 is conveyed to the second transferring part 22 in a suitable timing for the above-mentioned image forming operation. Then, in the second transferring part 22, the toner image having full color on the intermediate transferring belt 5 is second-transferred onto the sheet. The sheet with the second-transferred toner image is conveyed to a downstream side on the conveying path 20 to enter the fixing part 23, and then, the toner image is fixed on the sheet in the fixing part 23. The sheet with the fixed toner image is ejected from the ejection port 24 onto the ejected sheet tray 4.

Figure 2:
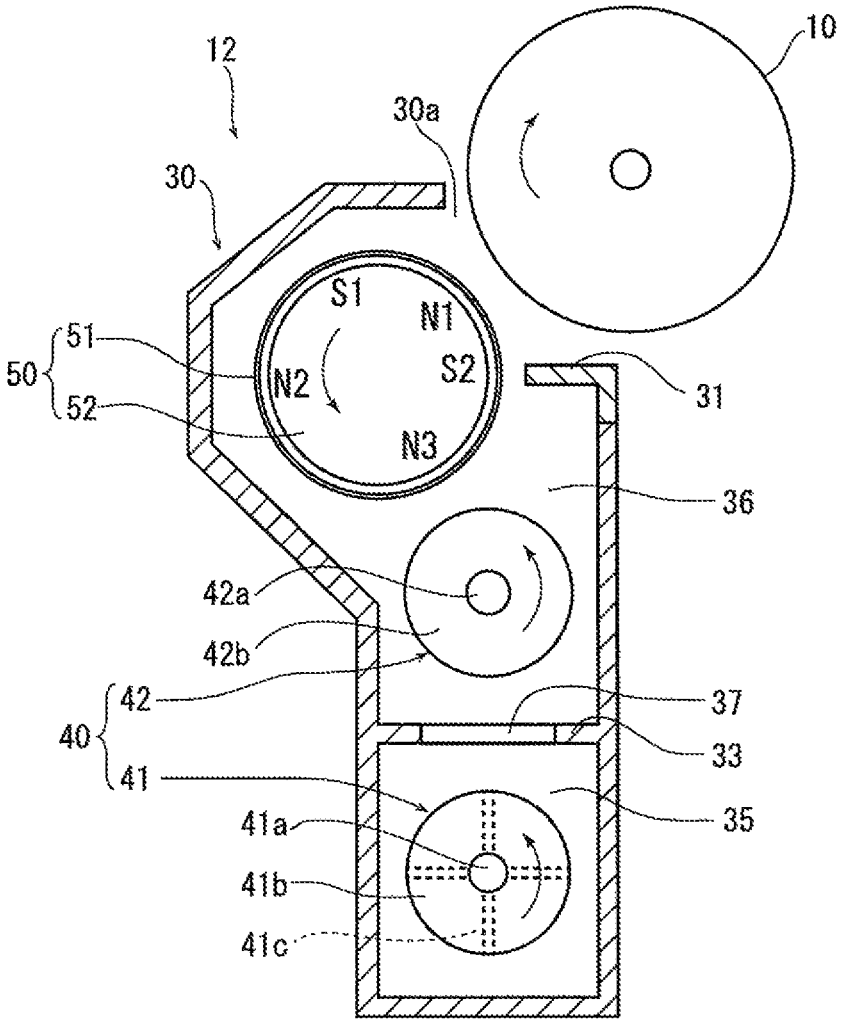
FIG. 2 is a lateral sectional view showing a development device of the color printer in accordance with the embodiment of the present disclosure.
Figure 3:
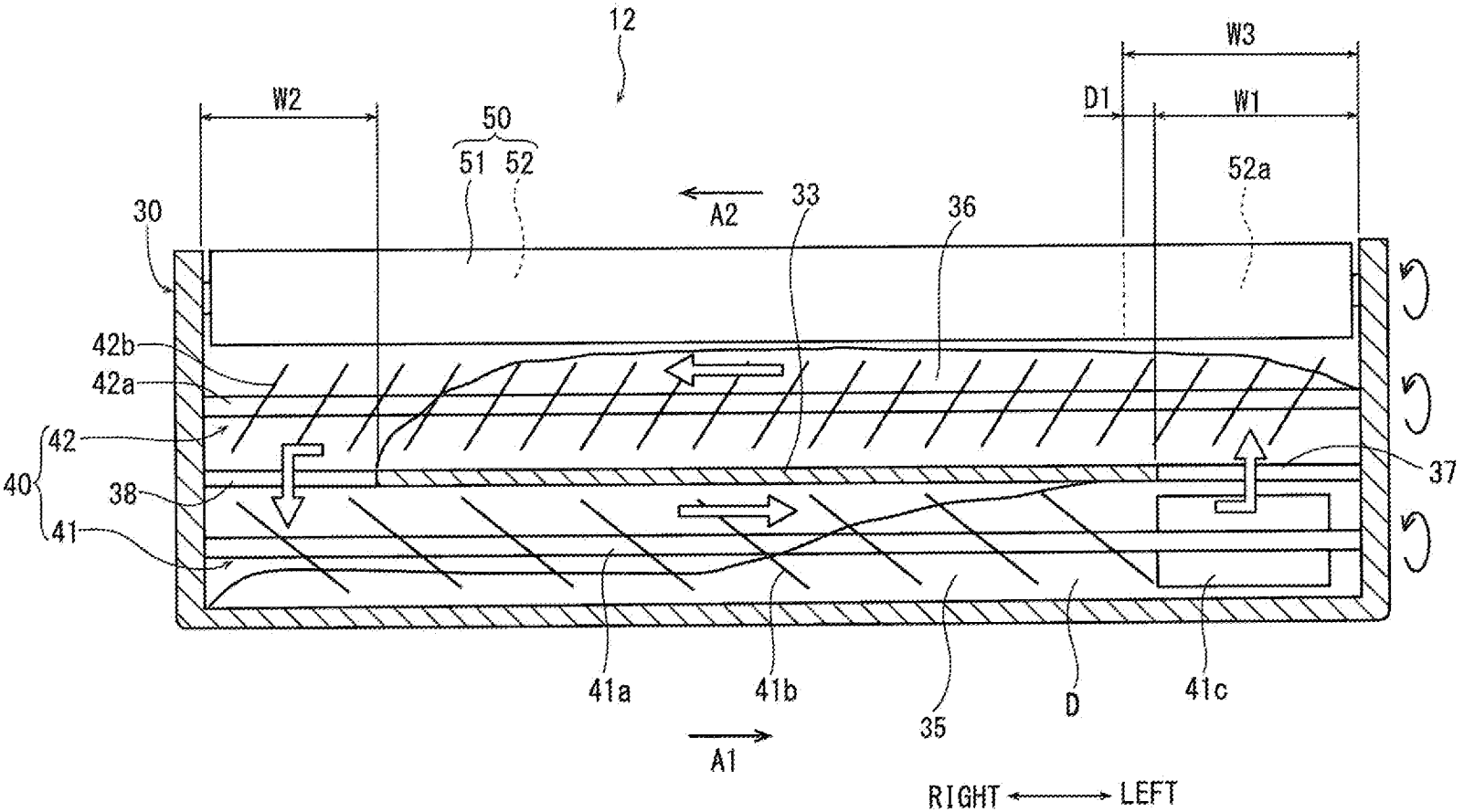
FIG. 3 is a sectional view showing the development device, as viewed of from the backside, of the color printer in accordance with the embodiment of the present disclosure.

Next, with reference to FIGS. 2 and 3, the development device 12 will be described. FIG. 2 is a lateral sectional view showing the development device and FIG. 3 is a sectional view showing the development device, as viewed of from the back side of the printer. The development device 12 includes a development case 30, an agitating/conveying member 40 and a developing roller 50 (a developer carrier).

The development case 30 is a case in which the agitating/conveying member 40 and developing roller 50 are supported and a developer (two-component developer consisting of a carrier and a toner) is stored. The development case 30 is a box-formed member having a vertically long side face shape and having a length roughly equal to a length in an axial direction of the photosensitive drum 10. At the back side of a top face of the development case 30, an opening 30*a* facing to a front lower side of the photosensitive drum 10 is formed so as to extend in the axial direction of the photosensitive drum 10. On a lower edge of the opening 30*a*, a regulating blade 31 regulating an amount of the developer is attached.

The inside of the development case 30 is partitioned into a first conveyance chamber 35 at the lower side and a second conveyance chamber 36 at the upper side by a partition board 33 (a partition part) arranged roughly horizontally. The first conveyance chamber 35 has a rectangular shape in the side view. The second conveyance chamber 36 is formed in an inverted trapezoid shape being approximately double a height of the first conveyance chamber 35 and having a width wider toward the upper side in the side view.

As shown in FIG. 3, at both left and right sides of the partition board 33, a first communicating portion 37 and a second communicating portion 38 communicating the first conveyance chamber 35 and second conveyance chamber 36 are provided. Incidentally, because FIG. 3 shows the development device 12 as viewed from the back side of the printer 1, the left-hand side and right-hand side of FIG. 3 indicate the inverse of the left and right directions of the printer.

The first communicating portion 37 has a width W1 of approximately 8% of the length of the photosensitive drum 10, e.g. the width of 20 mm. The second communicating portion 38 has a width W2 of approximately 8% of the length of the photosensitive drum 10, e.g. the width of 20 mm.

The agitating/conveying member 40 is configured to agitate, to frictionally charge and to convey the developer, simultaneously. The agitating/conveying member 40 includes a first spiral 41 and a second spiral 42.

The first spiral 41 is a screw conveyor having a length roughly equal to the length in the axial direction of the photosensitive drum 10. The first spiral 41 has a rotating shaft 41*a*, a spiral blade 41*b* formed in a dextrorse spiral shape at a constant pitch in an axial direction of the rotating shaft 41*a* and a drawing-up blade 41*c* formed in a left end of the rotating shaft 41*a*. The drawing-up blade 41*c* has four rectangular thin plates and the respective thin plates are radially extended from the rotating shaft 41*a* at equal central angles.

The first spiral 41 is positioned at the roughly center of the first conveyance chamber 35 of the development case 30 and both ends of the rotating shaft 41*a* are rotatably supported in the development case 30.

The second spiral 42 is a screw conveyor having a length roughly equal to the length in the axial direction of the photosensitive drum 10. The second spiral 42 has a rotating shaft 42*a* and a spiral blade 42*b* formed in a sinistrorse spiral shape at a constant pitch in an axial direction of the rotating shaft 42*a*. The pitch of the spiral blade 42*b* of the second spiral 42 is narrower than the pitch of the spiral blade 41*b* of the first spiral 41.

The second spiral 42 is positioned at a lower part in the second conveyance chamber 36 of the development case 30 so as to be above or right above the first spiral 41. Both ends of the rotating shaft 42*a* of the second spiral 42 are rotatably supported in the development case 30.

The developing roller 50 is configured to carry the developer by magnetic force and supply the developer on the surface of the photosensitive drum 10. The developing roller 50 is a columnar member having a length roughly equal to the length in the axial direction of the photosensitive drum 10. The developing roller 50 has a cylindrical sleeve 51 and a magnet roller 52 inserted into the sleeve 51. The developing roller 50 has the diameter of 16 mm.

The sleeve 51 is a cylindrical member made of non-magnetic material. To the sleeve 51, a developing bias taken by superposing direct voltage with alternating voltage is applied.

The magnet roller 52 is a columnar magnet and is magnetized with predetermined magnetic poles along a circumferential direction to have a main magnetic pole N1, a conveying magnetic pole S1, a separating magnetic pole N2, drawing-up magnetic pole N3 and a regulating magnetic pole S2 in a counter clockwise direction as viewed from the right side (refer to FIG. 2).

The main magnetic pole N1 is a magnetic pole used for supplying the developer on the photosensitive drum 10 and has magnetic flux density of 100 mT ($Wb/m^2$). Between the main magnetic pole N1 and conveying magnetic pole S1 and between the conveying magnetic pole S1 and separating magnetic pole N2, magnetic fields are generated to convey the developer from the main magnetic pole N1 to the separating magnetic pole N2. Because the separating magnetic pole N2 and drawing-up magnetic pole N3 are same pole, no magnetic field is generated between the separating magnetic pole N2 and drawing-up magnetic pole N3, and therefore, the developer is not supported on the surface of the sleeve 51, but falls. The drawing-up magnetic pole N3 is a magnetic pole used for drawing up the developer and has magnetic flux density of 45 mT. The regulating magnetic pole S2 is a magnetic pole used for regulating the amount of the drawn-up developer and has magnetic flux density of 60 mT.

As shown in FIG. 3, in the drawing-up magnetic pole N3 of the magnet roller 52 above the first communicating portion 37, a first ferromagnetic area 52*a* having magnetic flux density (magnetic force) higher than another area is provided. The first ferromagnetic area 52*a* has the magnetic flux density higher than the other area by 10 mT, e.g. the magnetic flux density of 55 mT. Incidentally, the first ferromagnetic area 52*a* has the maximum magnetic flux density of 60-70 mT (i.e. 20% to 50% higher than the other area).

The inner end of the first ferromagnetic area 52*a* is extended inwardly (in the direction toward the center) than the inner end (the end in the direction toward the center) of the first communicating portion 37 and reaches above the partition board 33. An extending distance D1 of the first ferromagnetic area 52*a* from the inner end of the first communicating portion 37 is set to preferably 5-50% of the width W1 of the first communicating portion 37, more preferably approximately 25%. For example, the first ferromagnetic area 52*a* has a width W3 of 25 mm and the extending distance D1 is 5 mm if the width W1 of the first communicating portion 37 is 20 mm.

As away of providing the first ferromagnetic area 52*a*, a way of strongly magnetizing a relevant area of the magnetic roller 52, a way of forming a piece with high magnetic flux density in advance and fitting the piece to a relevant area of the magnetic roller 52 or another way may be applied The developing roller 50 is positioned obliquely above the second spiral 42 in an upper part of in the second conveyance chamber 36 of the development case 30. The sleeve 51 of the developing roller 50 is rotatably supported in the development case 30 and the magnet roller 52 is inserted into the sleeve 51 and unrotatably fixed. The magnet roller 52 is positioned so that the main magnetic pole N1 faces to the photosensitive drum 10 through the opening 30*a* of the development case 30, the drawing-up magnetic pole N3 faces to the second spiral 42 and the regulating magnetic pole S2 faces to the regulating blade 31.

The rotating shaft 41*a* of the first spiral 41, the rotating shaft 42*a* of the second spiral 42 and the sleeve 51 of the developing roller 50 are driven by a driving mechanism (not shown) composed of a drive source, such as a motor, a deceleration device, gears and others arranged outside the development case 30 to rotate in the counter clockwise direction as viewed from the right side.

Next, an action of the development device 12 having the above-mentioned configuration will be described. When the driving mechanism is activated, in the first conveyance chamber 35, the rotation shaft 41*a* of the first spiral 41 is rotated, and accordingly, the developer D in the first conveyance chamber 35 is conveyed in a first direction A1 (one direction of the axial directions of the developer carrier) from the second communicating portion 38 to the first communicating portion 37 by the spiral blade 41*b*.

Since the pitch of the spiral blade 42*b* of the second spiral 42 is narrower than the pitch of the spiral blade 41*b* of the first spiral 41, in a case where the first spiral 41 and second spiral 42 are rotated at same rotation speed, a conveying speed by the first spiral 41 is faster than a conveying speed by the second spiral 42. Therefore, in the first conveyance chamber 35, much developers D are accumulated at a downstream portion in the first direction A1.

The developer D is conveyed to the downstream of the first conveyance chamber 35 and then drawn up to the second conveyance chamber 36 via the first communicating portion 37 by the drawing-up blade 41*c*. Since, at the downstream of the first conveyance chamber 35, the developers D are densely accumulated mentioned above and the developer D is conveyed by the rotation of the first spiral 41 without interruption, it is possible to securely draw up the developer D to the second conveying chamber 36 by the drawing-up blade 41*c*.

In the second conveyance chamber 36, the rotating shaft 42*a* of the second spiral 42 is rotated and the drawn-up developer D is conveyed in a second direction A2 from the first communicating portion 37 to the second communicating portion 38 by the spiral blade 42*b*. During this conveying, the developer D is drawn up to the drawing-up magnetic pole N3 of the developing roller 50 (refer to FIG. 2) to make a magnetic brush on the surface of the sleeve 51.

The magnetic brush is regulated to a predetermined height when passing between the regulating magnetic pole S2 and regulating blade 31. Subsequently, when the magnetic brush reaches the main magnetic pole N1, the magnetic brush is erected along lines of magnetic force toward the surface of the photosensitive drum 10 to come into contact with the surface of the photosensitive drum 10. At this time, according to a difference between an electrical potential of the electrostatic latent image formed on the photosensitive drum 10 and an electrical potential of the developing bias applied to the sleeve 51, the toner is supplied to the electrostatic latent image and the electrostatic latent image is visualized by the toner.

The developer D passed through the main magnetic pole N1 is conveyed from the conveying magnetic pole S1 to the separating magnetic pole N2, and then, dropped out from the surface of the sleeve 51 in an area where magnetic force between the separating magnetic pole N2 and drawing-up magnetic pole N3 is not generated. The dropped-out developer D falls to the lower part of the second conveyance chamber 36 along an inner wall of the development case 30.

The developer D containing the fallen developer conveyed to the downstream in the second direction A2 in the second conveyance chamber 36 passes through the second communicating portion 38 and falls to the first conveyance chamber 35. Thus, the developer D is agitated while circulating between the first conveyance chamber 35 and second conveyance chamber 36 (refer to a void arrow in FIG. 3) through the first communication portion 37 communicating end parts of the first conveyance chamber 35 and second conveyance chamber 36 in the first direction A1 and the second communication portion 38 communicating end parts of the first conveyance chamber 35 and second conveyance chamber 36 in the second direction A2.

As described above, in accordance with the development device 12 according to the embodiment of the present disclosure, since the first ferromagnetic area 52*a* is provided in the drawing-up magnetic pole N3 of the magnetic roller 52 above the first communicating portion 37, the drawing-up magnetic pole N3 can hold much developers D on the surface of the sleeve 51 and convey much developers D to the regulating magnetic pole S2. As a result, since density of the developers D in a space above the first communicating portion 37 is lowered, it is possible to smoothly draw up the developer D in the first conveyance chamber 35 through the first communicating portion 37 to the second conveyance chamber 36. Therefore, even if the first spiral 41 and second spiral 42 are disposed vertically, the amount of the developer supplied to the developing roller 50 in the first communicating portion 37 is increased, and accordingly, it is possible to solve insufficient of image density of a portion corresponding to the first communicating portion 37.

Moreover, since the first ferromagnetic area 52*a* is lengthened inwardly than the width of the first communicating portion 37, more amount of the developer D can be supplied to the developing roller 50 in the first communicating portion 37. In addition, since the developer D is supplied to the center portion of the second conveyance chamber 36, it is possible to smoothly convey the developer from the first communicating portion 37 to the center portion of the second conveyance chamber 36.

Further, since the first ferromagnetic area 52*a* is provided in a part of the developing roller 50 to increase a drawing-up amount of the developer D, it is unnecessary to lengthen lengths in the axial direction of the developing roller 50 and agitating/conveying member 40 to be equal to or more than the length in the axial direction of the photosensitive drum 10. In addition, new mechanism increasing the drawing-up amount is not required.

Therefore, it is possible to restrain cost increase by a simplified mechanism and to be prevented from lengthening the size in the forward and backward directions and in the left and right directions of the printer 1.

Figure 4:
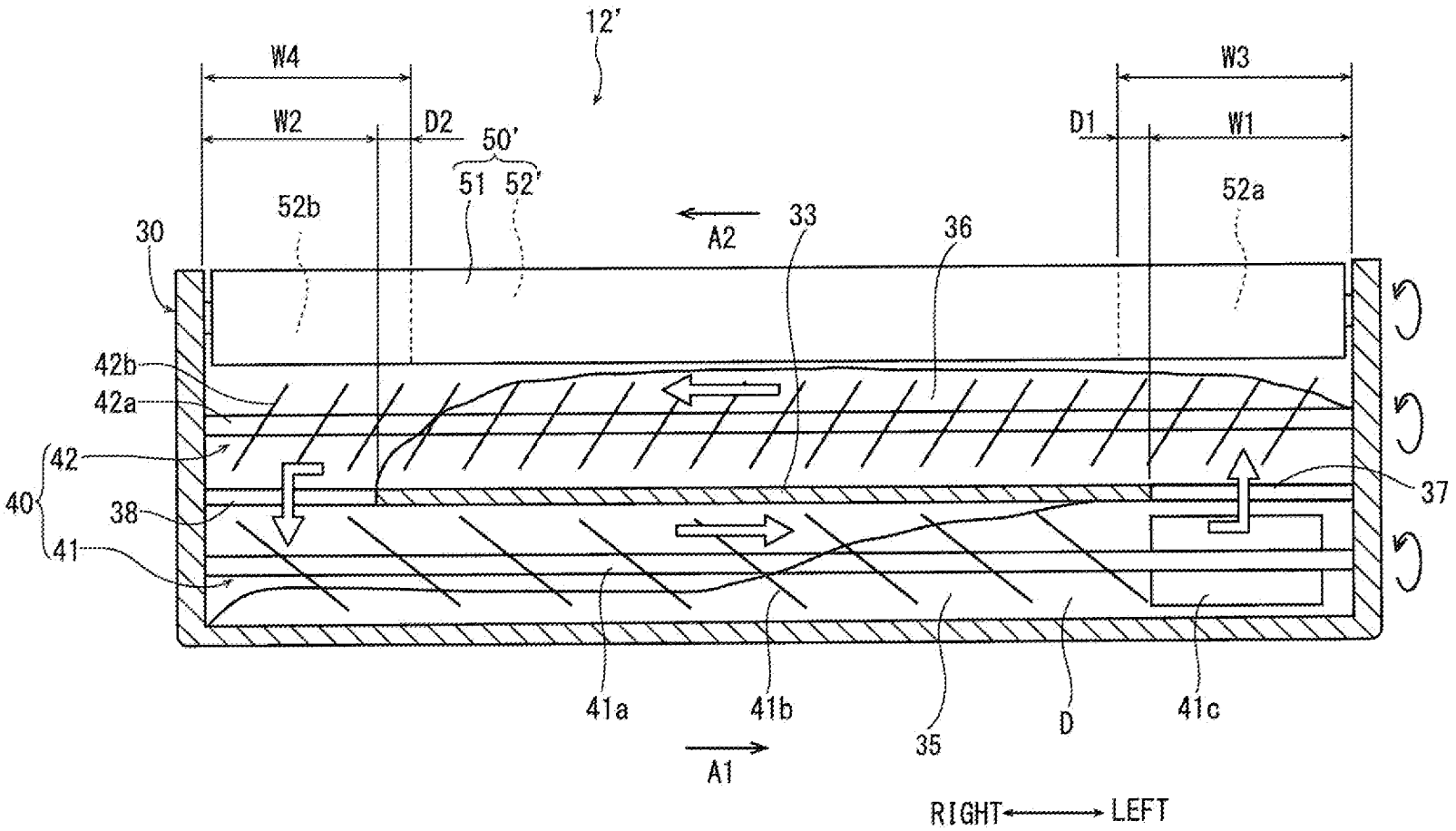
FIG. 4 is a sectional view showing the development device, as viewed of from the backside, of the color printer in accordance with another embodiment of the present disclosure.

Next, with reference to FIG. 4, the development device 12' according to another embodiment of the present disclosure. Incidentally, in FIG. 4, with respect to same components as the development device according to the above-described embodiment, same reference numerals as FIG. 3 are attached to the figure and the detail description is omitted.

In the development device 12', in the drawing-up magnetic pole N3 above the second communicating portion 38 of a magnetic roller 52' of the developing roller 50', a second ferromagnetic area 52*b* having magnetic flux density (magnetic force) higher than a center area is provided. The second ferromagnetic area 52*b* has the magnetic flux density higher than the center area by 10 mT, e.g. the magnetic flux density of 55 mT. Incidentally, the second ferromagnetic area 52*b* has the maximum magnetic flux density of 60-70 mT (i.e. 20% to 55% higher than the center area).

The inner end of the second ferromagnetic area 52*b* is extended inwardly (in the direction toward the center) than the inner end (the end in the direction toward the center) of the second communicating portion 38 and reaches above the partition board 33. An extending distance D2 of the second ferromagnetic area 52*b* from the inner end of the second communicating portion 38 is set to preferably 5-50% of the width W2 of the second communicating portion 38, more preferably approximately 25%. For example, the second ferromagnetic area 52*b* has a width W4 of 25 mm and the extending distance D2 is 5 mm if the width W2 of the second communicating portion 38 is 20 mm.

In accordance with the development device 12' according to the other embodiment, since the second ferromagnetic area 52*b* is provided in the drawing-up magnetic pole N3 of the magnetic roller 52' above the second communicating portion 38 in which the developer D falls from the second conveyance chamber 36 to the first conveyance chamber 35, the developer D hardly falls from the second communicating portion 38 to the first conveyance chamber 35 and the drawing-up magnetic pole N3 can hold much developers D on the surface of the sleeve 51. Therefore, it is possible to solve insufficient of image density of a portion corresponding to the second communicating portion 38.

Although it is preferable for solving the insufficient of the image density in the vicinities of both ends of the photosensitive drum 10 that, as the development device 12' according to the other embodiment, the first ferromagnetic area 52*a* and second ferromagnetic area 52*b* are provided, it is possible to obtain sufficient effect by the first ferromagnetic area 52*a*.

Incidentally, although, in the above-described embodiments of the present disclosure, the first spiral 41 and second spiral 42 are disposed vertically, the disposing direction is not restricted by the right vertical direction, but may be an oblique upward direction. The first spiral 41 and second spiral 42 may be disposed so as to correspond to a layout and others of the development device.

Although, in the above-described embodiments of the present disclosure, a case where the amount of the developer conveyed by the first spiral 41 is larger than the amount of the developer conveyed by the second spiral 42 was described, the amounts of the conveyed developers may be equal.

The embodiments of the present disclosure were described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A development device comprising:

a development case containing two-component developer consisting of a carrier and a toner;

a first agitating/conveying member and a second agitating/conveying member agitating and conveying the developer in the development case; and a developer carrier carrying the developer supplied from the second agitating/conveying member by magnetic force, wherein the first agitating/conveying member is arranged below the second agitating/conveying member to convey the developer in a first direction as one direction of the axial directions of the developer carrier, the second agitating/conveying member conveys the developer in a second direction as an opposite direction to the first direction to supply the developer to the developer carrier, the development case includes a first conveyance chamber in which the first agitating/conveying member is arranged, a second conveyance chamber in which the second agitating/conveying member is arranged, a partition part partitioning into the first conveyance chamber and second conveyance chamber, a first communicating portion communicating end parts of the first conveyance chamber and second conveyance chamber in the first direction, and a second communicating portion communicating end parts of the first conveyance chamber and second conveyance chamber in the second direction, the developer carrier has a first ferromagnetic area having magnetic force stronger than another area of the developer carrier, in which the first ferromagnetic area corresponds to the first communicating portion, the developer carrier has a second ferromagnetic area having magnetic force stronger than a center area in the axial direction of the developer carrier, in which the second ferromagnetic area is formed corresponding to the second communicating portion, the first ferromagnetic area is extended in a direction toward the center than an end of the first communicating portion in the direction toward the center and the second ferromagnetic area is extended in a direction toward the center than an end of the second communicating portion in the direction toward the center, the first ferromagnetic area is extended in the direction toward the center than the end of the first communicating portion in the direction toward the center by a distance of 5-50% of a width of the first communicating portion, and the second ferromagnetic area is extended in the direction toward the center than the end of the second communicating portion in the direction toward the center by a distance of 5-50% of a width of the second communicating portion.

2. The development device according to claim 1, wherein the first ferromagnetic area has magnetic flux density higher than the other area of the developer carrier by 20-55%.

3. The development device according to claim 1, wherein the second ferromagnetic area has magnetic flux density higher than a center area in the axial direction of the developer carrier by 20-55%.

4. An image forming apparatus comprising:

a development device, wherein the development device includes:

a development case containing two-component developer consisting of a carrier and a toner;

a first agitating/conveying member and a second agitating/conveying member agitating and conveying the developer in the development case; and a developer carrier carrying the developer supplied from the second agitating/conveying member by magnetic force, wherein the first agitating/conveying member is arranged below the second agitating/conveying member to convey the developer in a first direction as one direction of the axial directions of the developer carrier, the second agitating/conveying member conveys the developer in a second direction as an opposite direction to the first direction to supply the developer to the developer carrier, the development case includes a first conveyance chamber in which the first agitating/conveying member is arranged, a second conveyance chamber in which the second agitating/conveying member is arranged, a partition part partitioning into the first conveyance chamber and second conveyance chamber, a first communicating portion communicating end parts of the first conveyance chamber and second conveyance chamber in the first direction, and a second communicating portion communicating end parts of the first conveyance chamber and second conveyance chamber in the second direction, the developer carrier has a first ferromagnetic area having magnetic force stronger than another area of the developer carrier, in which the first ferromagnetic area corresponds to the first communicating portion, the developer carrier has a second ferromagnetic area having magnetic force stronger than a center area in the axial direction of the developer carrier, in which the second ferromagnetic area is formed corresponding to the second communicating portion, the first ferromagnetic area is extended in a direction toward the center than an end of the first communicating portion in the direction toward the center and the second ferromagnetic area is extended in a direction toward the center than an end of the second communicating portion in the direction toward the center, the first ferromagnetic area is extended in the direction toward the center than the end of the first communicating portion in the direction toward the center by a distance of 5-50% of a width of the first communicating portion, and the second ferromagnetic area is extended in the direction toward the center than the end of the second communicating portion in the direction toward the center by a distance of 5-50% of a width of the second communicating portion.

5. The image forming apparatus according to claim 4, wherein the first ferromagnetic area has magnetic flux density higher than the other area of the developer carrier by 20-55%.

6. The image forming apparatus according to claim 4, wherein the second ferromagnetic area has magnetic flux density higher than a center area in the axial direction of the developer carrier by 20-55%.

* * * * *